US006152120A

United States Patent [19]

Julazadeh

[11] Patent Number: 6,152,120

[45] Date of Patent: Nov. 28, 2000

[54] DIESEL ENGINE SYSTEM WITH OIL-AIR SEPARATOR AND METHOD OF OPERATION

[75] Inventor: Mahmood Julazadeh, Chillicothe, Ill.

[73] Assignee: Caterpillar Inc., Peoria, Ill.

[21] Appl. No.: 09/326,775

[22] Filed: Jun. 4, 1999

[51] Int. Cl.[7] ..... F01M 13/04

[52] U.S. Cl. ..... 123/572

[58] Field of Search ..... 123/572, 573, 123/574, 41.86

[56] References Cited

U.S. PATENT DOCUMENTS

| | | | |
|---|---|---|---|
| 2,198,819 | 4/1940 | Holm . | |
| 2,670,849 | 3/1954 | Dunmire . | |
| 2,733,855 | 2/1956 | McCoy . | |
| 3,127,255 | 3/1964 | Winslow . | |
| 3,262,573 | 7/1966 | Schutte . | |
| 3,363,771 | 1/1968 | Walters . | |
| 3,599,792 | 8/1971 | Stripp . | |
| 3,933,638 | 1/1976 | Isley . | |
| 4,119,542 | 10/1978 | Yamaoka et al. . | |
| 5,182,031 | 1/1993 | Lamort . | |
| 5,471,966 | 12/1995 | Feuling | 123/572 |
| 5,494,030 | 2/1996 | Meng | 123/572 |
| 5,499,616 | 3/1996 | Enright | 123/572 |
| 5,681,372 | 10/1997 | Magits | 123/41.86 |
| 5,697,349 | 12/1997 | Blum | 123/572 |

OTHER PUBLICATIONS

Osenga, "Racor's New Crankcase Vent System", *Diesel Progress*, Aug. 1998, pp. 78, 80, 81.

Racor, CCV–TECH.DOC, titled "RACOR CCV ™", Parker Hannifin Corporation (undated), pp. 1–8.

Walker Engineering, product information on "Airsep® Air/Oil Separator", Feb. 5, 1998, pp. 1–2.

Glacier Metal Co. Ltd., brochure "Engine Dirt and Related Wear", consisting of 8 pp., not dated, believed pre–1999.

*Primary Examiner*—Marguerite McMahon
*Attorney, Agent, or Firm*—Gordon H. Telfer

[57] ABSTRACT

A separator receives crankcase fumes having blowby gas and oil mist. A rotatable filter in the separator passes the gas constituents to an outlet for recycling back to an engine air intake. The filter, by rotating, causes oil to be flung centrifugally out onto a wall from which it can be drained from the separator and returned to the crankcase.

14 Claims, 2 Drawing Sheets

DIESEL ENGINE SYSTEM WITH OIL-AIR SEPARATOR AND METHOD OF OPERATION

TECHNICAL FIELD

This invention relates to diesel engines equipped with an oil-air separator to avoid emissions of crankcase fumes and fouling of the turbo compressor wheel.

BACKGROUND ART

Disposal of crankcase fumes from diesel engines can be an environmental problem, particularly with engines used in marine applications. The fumes are produced due to blowby gas escaping past piston rings due to high pressure on fuel and air during compression and combustion. The blowby gas enters the engine crankcase where it picks up oil so the fumes include the blowby gas and an oil mist. In many applications, the fumes are merely released to the atmosphere which can cause undesirable oil deposits.

In marine applications, where avoidance of the emissions has been mandated by regulations, a practice has been to introduce the fumes into the engine air intake along with fresh air for consumption by the engine. That is adverse to the effective life of the air filter. Also, as the fumes pass through a typical engine system, including a turbocharger compressor, the compressor wheel becomes coated with oil deposits. This results in loss of compressor efficiency which leads to other problems with engine aspiration and smoke.

It has been recognized that it would be desirable to separate the oil from the rest of the fumes (generally referred to as "air" but containing gases that may include fuel vapor in addition to ambient air) prior to reintroducing the fumes back into the engine. Known separators proposed for this purpose either use induction air to coalesce the hot oil vapor into liquid or have a stationary filter with a diaphragm/valve assembly to regulate pressure.

SUMMARY OF THE INVENTION

The invention provides an oil-air separator that utilizes centrifugal force to separate oil from the rest of the crankcase fumes. In one form, the separator has a filter mounted on a shaft for rotation with a filter medium that allows easy passage of air, and other vapor, in the blowby gas. The oil component of the fumes tends to cling to the filter but, under rotation, does not adhere and is instead flung out onto a surface for collection. The air or vapor component is routed to the engine air inlet to mix with fresh air for consumption by the engine. The oil that is collected is routed back to the crankcase.

The rotation of the filter is chosen to be at a speed sufficiently high to overcome the shear force of the oil on the filter. Various drive mechanisms can be employed including one in which a turbine wheel, such as a pelton wheel, is connected with the filter shaft. Engine oil under pressure is directed onto the wheel to impart rotational motion to the filter.

The invention provides a way to separate the oil from the crankcase fumes and return the oil to the crankcase to be used again. This eliminates the need for adding oil as frequently and reduces the emissions by not burning the oil in the combustion process. It is believed to be economical, effective and reliable for its intended purposes without imposing significant additional maintenance requirements.

DESCRIPTION INCLUDING PREFERRED EMBODIMENTS

Figure 1:
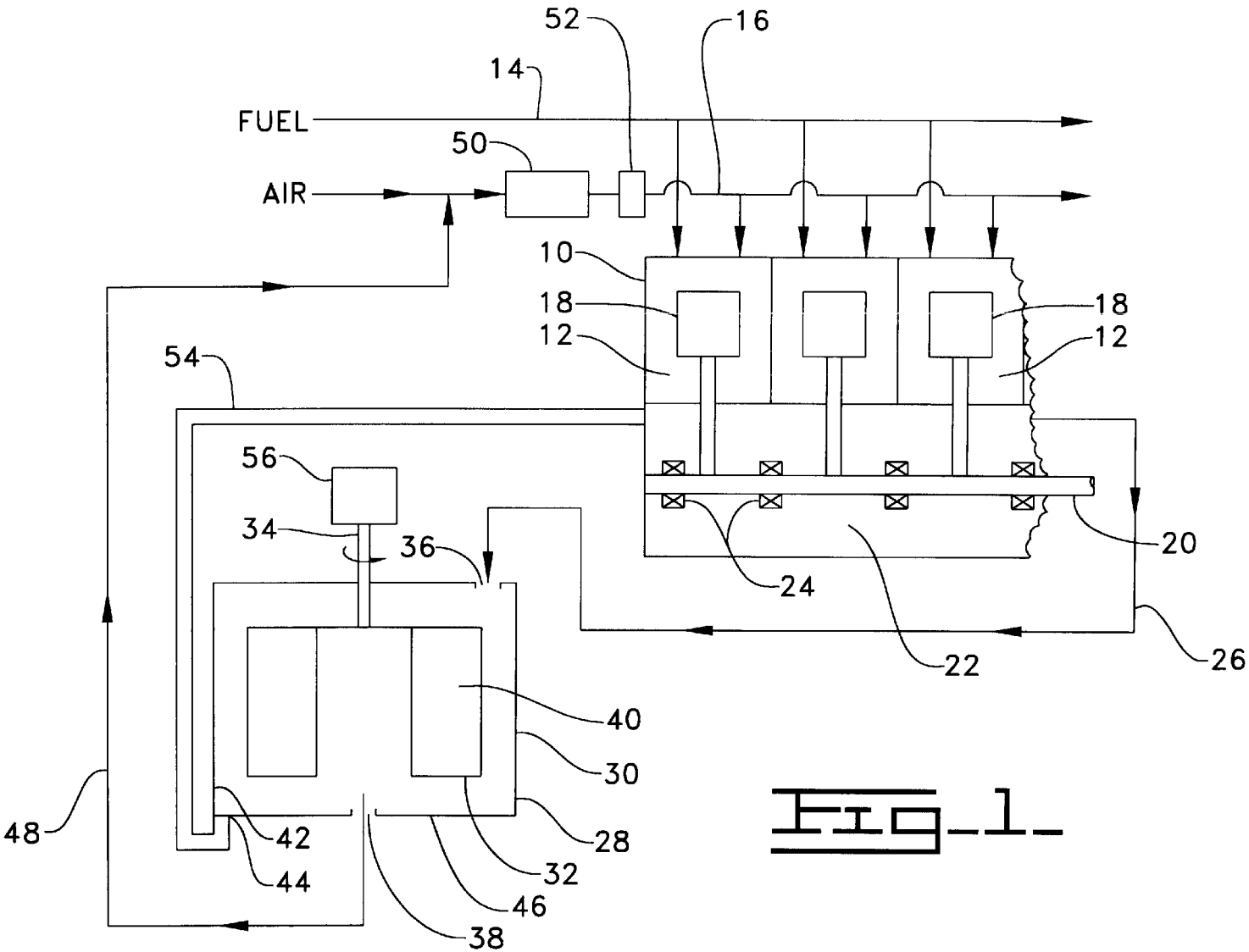
FIG. 1 is a schematic view of an engine system in accordance with the invention.

Referring to FIG. 1, an engine system is shown in a general, schematic view to illustrate an example application of the invention. The system includes an engine 10 having cylinders or combustion chambers 12 that each receive fuel and air from their respective supply paths 14 and 16. Pistons 18 operate on a crankshaft 20 to go through a conventional combustion cycle that results in an exhaust (not illustrated). Engine 10 is shown partially, indicating any chosen number of cylinders 12 may be present. As is well known, some of the fuel-air mix and combustion by products, called blowby gas, passes the pistons 18, and their piston rings, into a part of the engine called a crankcase 22 that contains lubricating oil for bearings 24 on which the crankshaft 20 runs.

The blowby gas picks up oil from the crankcase 22 to create crankcase fumes. The fumes are passed, according to the invention, through a conduit 26 to an oil-air separator 28 to separate oil form the "air", including air and fuel vapor, in the fumes. The separator 28, an example of which is more fully shown in FIG. 2, includes a housing or chamber 30 in which an annular filter element 32 is contained and mounted for rotation on a shaft 34. The chamber has an inlet 36 for the crankcase fumes so they reach the outside of the annular filter 32 and has an outlet 38 more centrally arranged along the axis of rotation of the filter for removal of air and other vapor that passes through the filter.

Oil in the fumes introduced to the separator 28 tends to cling to the material or medium 40 of the filter element 32, while the vapor passes through. The oil does not merely collect on the filter, however. The rotational speed of the filter 32 is sufficiently high so the oil is dislodged and is flung onto the wall or side 42 of the chamber 30 from which it falls under gravity to reach a drain 44 leading from the chamber.

In the example of FIG. 1, the filter shaft 34 is oriented vertically and the bottom of the chamber is configured so the outlet air and drained oil are restricted to their intended passages 38 and 44. For example, the outlet 38 for the air and vapor may be raised from the center of the bottom surface 46 so as not to draw oil. Also, of course, the bottom 46 can be tilted to help oil get to the drain 44.

The gas outlet 38 is connected through a conduit 48 back to an engine air inlet in the air path 16, shown here on the inlet side of a standard engine air filter 50. The return air conduit 48 may, alternatively, join the intake air path 16 after the air filter 50 anywhere along the air path 16. In either case, the air path 16 may transfer air not only to the engine 10 but also to a compressor and/or turbocharger 52 as are typically used in diesel engine systems and are susceptible to problems if the incoming air contains oil.

The drain 44 from the separator chamber 30 directs oil back to the crankcase through a conduit 54. The location of the separator 28 may, rather than as shown for convenience in FIG. 1, be elevated in relation to the crankcase 22 so gravity assists the oil flow.

As shown, the system of FIG. 1 recycles continuously both the air-vapor and oil components of the crankcase fumes and those fumes are not released nor are the fumes with the oil directed through the turbocharger compressor. The rotation of the filter 32 in the separator 28 that flings off the oil helps to keep the filter clean and operative with low maintenance.

The invention, therefore, includes a method of operating a diesel engine 10 to avoid emissions of crankcase fumes by conducting fumes from the crankcase 22 to a separator 28 having a filter 32, preferably an annularly shaped filter. In the separator 28, there is filtering of the air and other vapors from the fumes by the filter 32 while rotation of the filter 32 centrifugally flings oil out into a separator wall 42. The air and vapor is conducted to an air inlet 16 of the engine while the oil is collected in a drain 44 from the separator and conducted back to the crankcase 22.

In practicing the invention, any of various filters and filter drive mechanisms may be used. The size of the filter is chosen to be sufficient to handle the quantity of expected fumes, typically about 1 cubic feet per horsepower per hour.

The filter 32 includes a filter medium 40 such as a wire mesh or a fiberglass selected as to pore size, volume and surface characteristics so the vapor component of the fumes can readily pass through it and, during rotation, at least a substantial part of the oil does not pass through and instead is flung outward onto the chamber wall 42.

A drive mechanism 56 to rotate the shaft 34 and filter 32 can be, for example, a mechanical drive linked to the engine through gearing or the like. It may alternatively be a drive powered by an electric motor. Another form of drive, discussed below with FIG. 2, uses a pressurized fluid impinging on a turbine wheel on the shaft of the filter. The drive mechanism 56 is configured to rotate the filter 32 at a speed sufficient for its purposes. The drive 56 may operate at a substantially constant speed sufficient under a wide range of engine operating conditions. However, if desired, there may be a variable speed drive that depends, for example, on various parameters such as engine temperature which would affect oil viscosity.

Variations can include orienting the separator so the fumes enter the bottom rather than the top of the chamber 30, and the filtered air is removed from the top. The drive mechanism 56 can be arranged under the separator chamber.

Furthermore, it can be suitable for the filter 40 and shaft 34 to be horizontal rather than vertical, or at another orientation.

Figure 2:
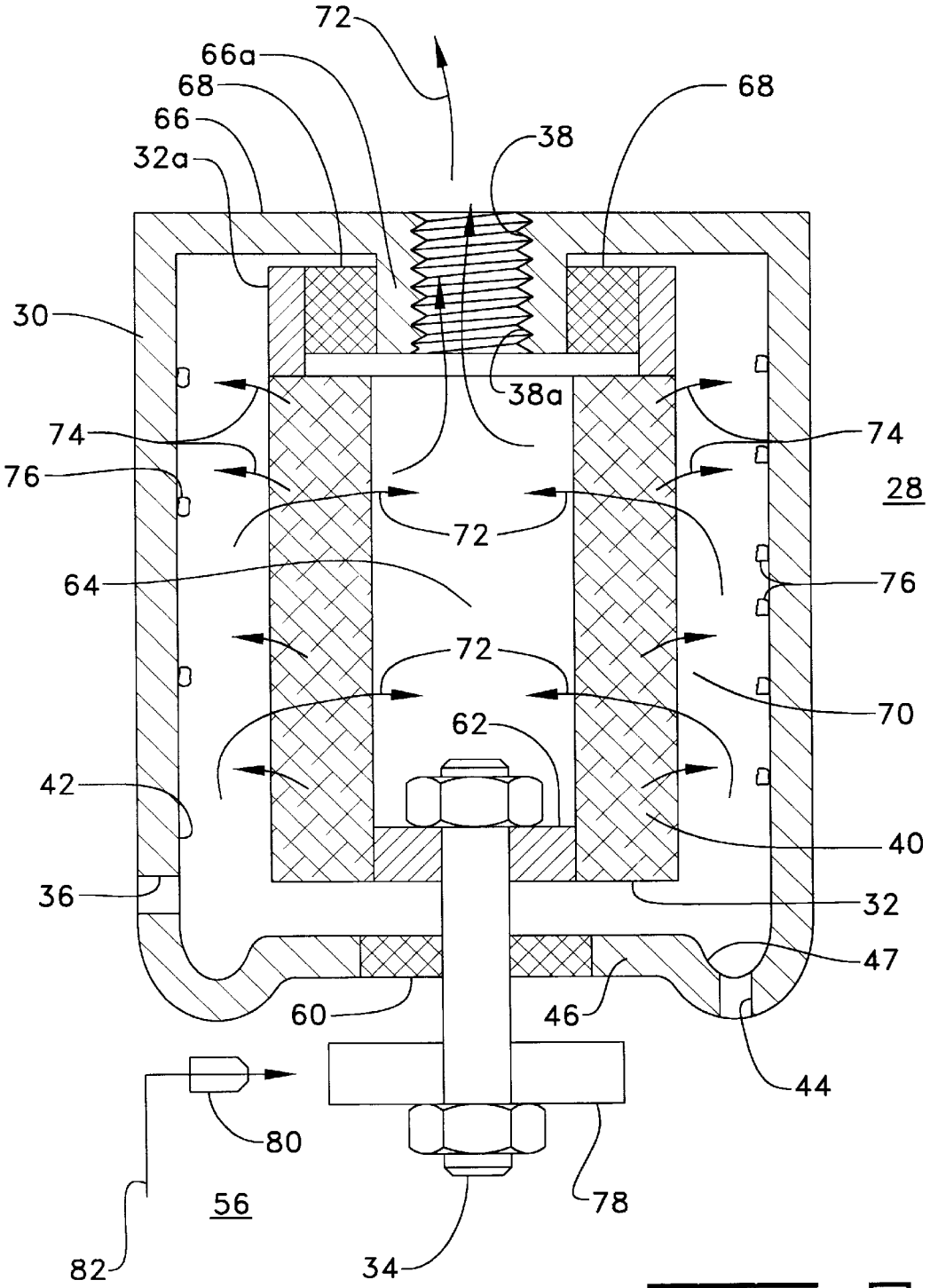
FIG. 2 is a cross-sectional view of an example of a oil-air separator in accordance with the invention.

FIG. 2 shows a version of the separator 28, and its drive mechanism 56. Corresponding elements of FIG. 2 and FIG. 1 are like numbered but may be located differently to show alternatives. The separator chamber 30 contains the filter 32 on a shaft 34. The shaft 34 in this example extends through bottom 46 of the chamber 30, mounted on a shaft bearing 60. The shaft 34 extends into chamber 30 far enough to engage and hold securely a hub or frame 62 of the filter 32 but leaving an appreciable interior space 64 free. At the upper end 66 of the chamber 30, the filter 32 runs on a bearing 68 between projections 32*a* and 66*a* of the filter and the chamber wall.

The filter 32 has an annular portion bearing the filter medium 40. An inlet 36 into chamber 30 for crankcase fumes comprises an aperture, which may include a threaded fitting, through a wall of the chamber so the fumes enter a space 70 outside of the annular filter 32. Arrows 72 show the passing of air and vapor through the filter 32 into the filter's interior space 64 and through an outlet port 38, substantially along a line from the axis of the shaft 34. The outlet port 38 is shown with threads 38*a* for attachment of a coupling with a conduit for return of the gaseous elements back to an engine air intake.

In FIG. 2, the chamber wall 42 lateral to the shaft axis is a substantially cylindrical surface. Oil flung radially outward by the rotating filter 32, shown by arrows 74, results in particles 76 on the surface 42 that will eventually collect at a drain 44 in the bottom surface 46 from which they flow back to the crankcase 22. Drain 44 may also include a threaded fitting for connection with a conduit. To facilitate oil collection, a trough or channel 47 extends around the periphery of surface 46 and drain 44 occurs at the bottom thereof.

As was discussed above in connection with FIG. 1, various geometries can be used and the surface to which the oil flows by gravity can be shaped, such as with a channel 47, to help draining.

The drive mechanism 56 of FIG. 2 comprises a turbine wheel 78 mounted on the shaft 34 below the chamber 30. The turbine wheel 78 may be of the type known as a Pelton wheel which receives a driving fluid through a nozzle. Here, a nozzle 80 receives pressurized oil 82 from the engine.

The separator 28 may be variously arranged in physical relation to the engine 10. For example, in one form, a separator 28 as shown in FIG. 2 is located on a support that is cast with or bolted to the block of the engine. The support is provided with a path for conduction of pressurized oil from the block to the nozzle 80 for driving the turbine wheel 78. Additionally, the support and the end of the separator can be shaped to fit together and fastened, such as by a V-clamp or the like.

In its various forms, it is preferred to use a durable, cleanable, material as the filter medium. For example, a wire or fiberglass mesh filter may be disassembled from the separator after a substantial period of use and chemically cleaned to remove lacquer residue from the filtered vapors and then reused. A paper filter could be used but is likely to require replacement more often.

It will be recognized that the invention can take other forms than those specifically shown and described herein.

INDUSTRIAL APPLICABILITY

The invention provides an engine system with an oil-air separator that is effective and reliable. The separator can be part of an original manufacture integrated with an engine block or can be retrofitted into a system with an existing engine as an aftermarket, add-on device.

Engine manufacturers and their customers can now have a further option for how to satisfy existing or contemplated environmental regulations for control of emissions. The invention can be applied in any application and achieve good economical operation through recycling as well as avoidance of unwanted emissions.

The invention helps minimize added maintenance by utilizing centrifugal action to remove oil from the fumes. The filter itself can be of a durable material and cleaned occasionally for reuse, if desired.

What is claimed is:

1. An oil-air separator, for an engine having a crankcase producing fumes containing oil and gas that includes air, comprising:

a chamber containing a filter rotatable about a shaft;

an inlet port for fumes from a crankcase into a region of the chamber radially outside the filter;

an outlet port from the chamber for gas separated from oil in the fumes;

a drain for oil that has been centrifugally flung radially out from the rotatable filter; and, a drive mechanism on the shaft on which the filter rotates comprising a turbine wheel positioned to receive a pressurized fluid to drive the wheel.

2. The separator of claim 1 wherein: the pressurized fluid which the turbine wheel is positioned to receive is engine oil.

3. The separator of claim 1 wherein:

the outlet port for gas is arranged in communication with an air inlet to the engine; and, the drain for oil is arranged in communication with the crankcase.

4. The separator of claim 1 wherein: the filter is substantially an annulus rotating about the shaft axis and has a filter medium that during rotation by the drive mechanism substantially prevents oil from the fumes passing radially inward and flings oil out against a wall of the chamber.

5. The separator of claim 4 wherein: the filter shaft is oriented vertically and oil collects in a channel of the chamber surface having the drain.

6. A diesel engine system comprising:

an engine with combustion chambers which operate at pressures such that blowby gas escapes into a crankcase containing engine lubricating oil producing a mixture of blowby gas, including air, and oil mist;

an oil-air separator connected by a first conduit with the crankcase to receive the mixture of blowby gas and oil, where the separator comprises an annular filter element mounted for rotation on a shaft within a chamber having an inlet for the mixture to an outer surface of the filter element and an outlet for gas passing into and through the filter element, a drain for removal from the chamber of oil separated from the gas by the oil having been centrifugally flung against a wall of the chamber;

the outlet of the separator chamber being connected by a second conduit to supply blowby gas from which oil has been separated to an engine air inlet, and the drain of the separator chamber being connected to the crankcase.

7. The system of claim 6 wherein:

a drive mechanism is connected with the shaft of the separator filter and is arranged to rotate the filter at a speed sufficient to prevent oil from the mixture passing radially inward of the filter.

8. The system of claim 6 wherein:

the engine air inlet to which the outlet of the separator chamber is connected is on the inlet side of an engine air filter.

9. The system of claim 6 wherein:

the engine air inlet to which the outlet of the separator chamber is connected is on the engine intake air path after an engine air filter and before a turbocharger in the air path.

10. The system of claim 8 wherein:

the separator and the respective first, second, and third conduits are each free of any added pressure regulator.

11. The system of claim 7 wherein:

the drive mechanism is operable at a variable speed.

12. A method of operating a diesel engine to avoid emissions of crankcase fumes containing blowby gas and oil mist, comprising the steps of:

conducting crankcase fumes from the crankcase to a separator having an annular filter;

rotating the filter and separating oil from the fumes by centrifugally flinging oil onto a surface for collection in a drain;

conducting oil from the separator drain to the crankcase;

conducting gas left from the fumes after separating the oil to an air inlet of the engine;

the conducting of the crankcase fumes to the separator includes passing fumes into an outer annular space around the filter; and the conducting of the gas left from the fumes after separating the oil includes passing the gas from an inner space within the filter.

13. The method of claim 12 wherein:

the rotating of the filter includes rotating a shaft on which the filter is mounted by supplying pressurized engine oil through a nozzle onto a turbine wheel mounted on the shaft exterior to a chamber containing the filter.

14. The method of claim 12 wherein:

the conducting of crankcase fumes from the crankcase to the separator is performed by directly passing the fumes without influence of a pressure regulator.

* * * * *